US007364159B2

(12) United States Patent
Berman et al.

(10) Patent No.: US 7,364,159 B2
(45) Date of Patent: Apr. 29, 2008

(54) SYSTEM AND METHOD FOR PRESENTING PAYOUTS IN GAMING SYSTEMS

(75) Inventors: Bradley Berman, Minnetonka, MN (US); Adam Martin, St. Louis Park, MN (US)

(73) Assignee: King Show Games, Inc., Minnetonka, MN (US)

( * ) Notice: Subject to any disclaimer, the term of this patent is extended or adjusted under 35 U.S.C. 154(b) by 226 days.

(21) Appl. No.: 10/983,958

(22) Filed: Nov. 8, 2004

(65) Prior Publication Data

US 2005/0119040 A1 Jun. 2, 2005

Related U.S. Application Data

(60) Provisional application No. 60/518,372, filed on Nov. 8, 2003.

(51) Int. Cl.
*A63B 71/00* (2006.01)
*A63F 1/00* (2006.01)

(52) U.S. Cl. ..... 273/138.1; 463/16; 463/18; 463/19; 463/20; 463/25; 463/30; 463/37; 273/143 R; 273/139

(58) Field of Classification Search ..... 463/16, 463/18, 19, 20, 25, 30, 37; 273/143 R, 138.1, 273/139
See application file for complete search history.

(56) References Cited

U.S. PATENT DOCUMENTS

| | | | | |
|---|---|---|---|---|
| 3,971,557 | A | 7/1976 | Breslow et al. | |
| 4,927,015 | A * | 5/1990 | Jones | 206/315.9 |
| 6,595,854 | B2 * | 7/2003 | Hughs-Baird et al. | 463/20 |
| 2002/0187827 | A1 * | 12/2002 | Blankstein | 463/20 |
| 2003/0087686 | A1 | 5/2003 | Yu et al. | |
| 2004/0048644 | A1 * | 3/2004 | Gerrard et al. | 463/16 |
| 2005/0054414 | A1 * | 3/2005 | Gauselmann | 463/16 |
| 2005/0059459 | A1 * | 3/2005 | Dunn et al. | 463/16 |

* cited by examiner

*Primary Examiner*—Robert E. Pezzuto
*Assistant Examiner*—Jason Pinheiro
(74) *Attorney, Agent, or Firm*—Hollingsworth & Funk, LLC

(57) ABSTRACT

A system and method for facilitating a shell game activity as a primary or secondary/bonus gaming activity in a mechanistic, electronic, or combined mechanistic/electronic manner. Embodiments of methods for presenting gaming payouts involve providing an automated shell-game device and presenting, to a player, a plurality of award elements having a positional relationship to one another, using the automated shell-game device. The plurality of award elements are obscured from the player's view, and subjected to an apparent shuffling in terms of relative position as perceived by the player. A selected award element is revealed to the player subsequent to the apparent shuffling, and a payout result is determined, based on the selected award element.

11 Claims, 10 Drawing Sheets

*FIG. 3*
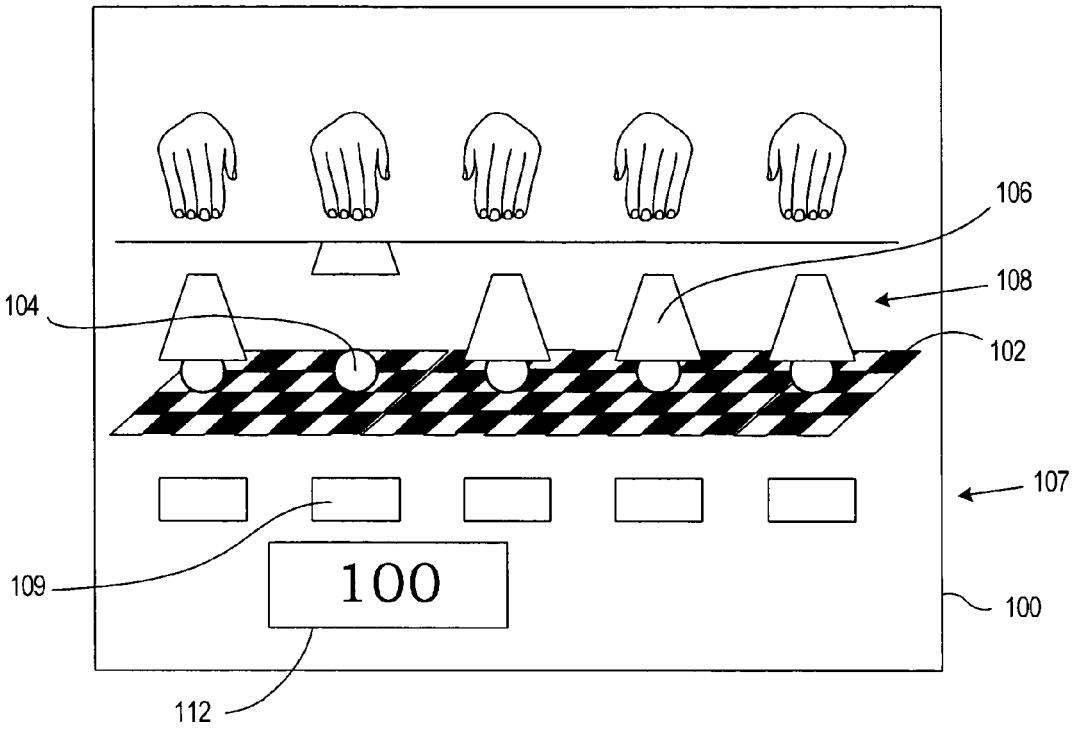
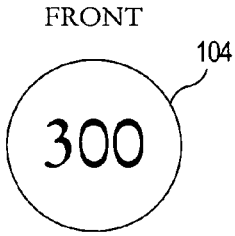
*FIG. 4*
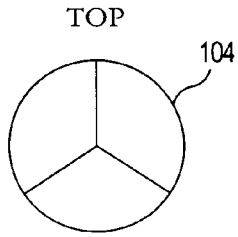
*FIG. 5*

SYSTEM AND METHOD FOR PRESENTING PAYOUTS IN GAMING SYSTEMS

RELATED APPLICATIONS

This application claims the benefit of Provisional Patent Application Ser. No. 60/518,372, filed on Nov. 8, 2003, to which priority is claimed pursuant to 35 U.S.C. §119(e) and which is hereby incorporated herein by reference.

FIELD OF THE INVENTION

This invention relates in general to gaming, and more particularly to a system and method for presenting payouts in gaming systems.

BACKGROUND OF THE INVENTION

Gaming devices such as slot machines have been in use in the U.S. for over a century. The earliest slot machines originally paid out in cigars and chewing gum. Remnants of the early slot machines are manifested in the traditional "fruit" symbols such as cherries, lemons, oranges, etc., which represent the original flavors of gum. Notwithstanding the similarity of the symbols and reels associated with the slot machines of both today, and yesteryear, modern day slot machine implementations are markedly different than their mechanical ancestors. This dramatic implementation disparity results primarily from the advent of computers and video capabilities.

Pure chance gaming devices such as slot machines have proved wildly popular, and in recent years have rivaled and even surpassed their once untouchable table game counterparts. One reason for this popularity is the increase in innovation, and the recognition of the need for human stimulation. While true that a primary motivator for people to play gaming devices is the chance to win monetary or other prizes (in the case of legalized gambling), the intrigue and excitement of playing these newly created machines lures people as well. It is therefore important in the gaming industry that gaming innovations be rolled out to the participating public.

Conventionally, participation in slot machines involves initiating the rotation of multiple reels, and allowing the machine to randomly stop the reel rotation such that associated reel symbols line up a payline. If the symbols on that payline correspond to a predetermined symbol combination, the participant wins an amount corresponding to the particular symbol combination. For multi-lined paylines, a coin or other token may be played for any one or more of the available paylines, and each of the paylines may provide a winning payout. When this occurs, the slot machine pays out according to the payoff table posted on the slot machine. The payoff table informs players of the winning symbol combinations for that machine, and what each combination pays based on the number of coins allocated for the spin. If a winning combination occurs, the machine releases money or tokens into a payout chute, or may award the winning amount onto a credit meter for the player. For example, if a player initially wagered three coins and that player won a high payout, that player may receive fifty coins of the same denomination in return, or may receive fifty credits for continued play.

It is a continual effort in the gaming industry to develop ways to attract and captivate players in playing gaming machines, such as slot games. One such manner of stimulating interest and heightening excitement has been through the use of "bonus" events. Bonus events or games are used to attract and keep players at a gaming machine. A bonus game is typically an additional gaming reel or machine, or a random selection device, that is enabled by a bonus qualifying signal from an underlying or primary gaming machine. Generally, a predetermined prize-winning combination of symbols in an underlying or primary game may result in the player being awarded one or more bonus games. Often the bonus event has a much higher probability of winning, thereby instilling a great interest by players in being awarded bonus events.

There are various secondary or "bonus" events known in the art. One such bonus event allows the player to depress a bonus spin button to allow the player one or more additional free spins in which a winning payout may be made. Alternatively, additional, discrete bonus reels may be used for the bonus event. In such case, a particular symbol on any one or more of the reels, which are stopped on a winning line, may result in a winning payout. In some bonus activities, the reels may be controllable in a bonus play, unlike the underlying primary gaming play. For example, the reels may be individually stopped, and/or the reels may be rotated slower to allow the player to attempt to stop the reel such that the prize-winning symbol stops on the win line. In another example, a bonus event for a video slot machine may have a second screen where the player is rewarded with a bonus game, such as allowing the player to pick one of five different items on the second screen, and the selected item reveals a value won by the player. In recent times, bonus events have become quite extravagant, sometimes leading the player through video animations that provide visual and audio entertainment while providing clever ways in which the participant can receive payouts of varying quantities. After engaging in the bonus event, play resumes in the underlying, primary gaming machine.

In furtherance of the need to attract casino patrons, there is a continuing need to further the excitement and visual stimulation in the participation of gaming activities. The present invention fulfills these and other needs, and offers advantages over prior art gaming approaches.

SUMMARY OF THE INVENTION

To overcome limitations in the prior art described above, and to overcome other limitations that will become apparent upon reading and understanding the present specification, the present invention discloses a system, apparatus, and method for conducting a shell game activity. The present invention allows for playing of a shell game activity implemented as a primary or secondary/bonus gaming activity in a mechanistic, electronic, or combined mechanistic/electronic manner.

Embodiments of the present invention are directed to methods for presenting gaming payouts involving providing an automated shell-game device and presenting, to a player, a plurality of award elements having a positional relationship to one another, using the automated shell-game device. The plurality of award elements are obscured from the player's view, and subjected to an apparent shuffling in terms of relative position as perceived by the player. A selected award element is revealed to the player subsequent to the apparent shuffling, and a payout result is determined, based on the selected award element.

The apparent shuffling may be performed entirely, or at least in part mechanistically in some embodiments, while other embodiments perform the apparent shuffling entirely, or at least in part, electronically. The plurality of award elements may be obscured by lowering a cup over each of the plurality of award elements, and the selected award element may be revealed by raising the cup associated with the selected award element. Embodiments of gaming payout methods in accordance with the present invention provide for at least one of the plurality of award elements to include a terminate indicator. Methods may involve repeatedly revealing selected award elements and determining payout results until the terminate indicator is selected. Other embodiments include advance and terminate indicators, where repeatedly revealing selected award elements and determining payouts continues until the advance or terminate indicator is selected. If the advance indicator is selected, the player is advanced to a next level of play. If the terminate indicator is selected or a final level is reached, the payout method stops.

Other embodiments may involve repeatedly revealing selected award elements to the player subsequent to the apparent shuffling, each revelation providing a digit. The payout result may be based on the selected award elements by appending the digit from each selected award element to a payout until a predetermined number of digits are reached or until the termination symbol is selected.

Further embodiments in accordance with the present invention are directed to an apparatus for presenting gaming payouts, including a floor structure having false floor elements. Award elements are configured to couple to the plurality of false floor elements. Obscuring elements are used to selectively obscure the award elements. An obscuring element manipulator controls manipulation of the obscuring elements, thereby performing an apparent shuffling. A user selection interface facilitates user selection of one or more of the award elements. The user selection interface may be coupled to the obscuring element manipulator, such that the obscuring element manipulator reveals the award elements in response to a user selection.

Exemplary embodiments in accordance with the present invention include balls as the award elements, each ball segmented into a plurality of segments, each segment having a symbol presented on the segment. Symbols may include a stop symbol or other termination indicator, and a re-spin symbol or other game continuation symbol, as well as wild symbols and/or other gaming symbols. An apparatus for presenting gaming payouts in accordance with the present invention may be provided as a bonus feature of a gaming system, such as a slot machine, video poker machine, bingo machine, or keno machine.

These and various other advantages and features of novelty which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described specific examples of a system, apparatus, and method in accordance with the invention.

BRIEF DESCRIPTION OF THE DRAWINGS

The invention is described in connection with the embodiments illustrated in the following diagrams.

FIG. 3 is an illustration of a shell game activity at a user selection phase in accordance with an embodiment of the present invention;

FIG. 4 is a side view illustration of an award element embodied as a three-sided ball for a shell game activity in accordance with an embodiment of the present invention;

FIG. 5 is a top view illustration of an award element embodied as a three-sided ball for a shell game activity in accordance with an embodiment of the present invention;

DETAILED DESCRIPTION OF EMBODIMENTS OF THE INVENTION

Figure 1:
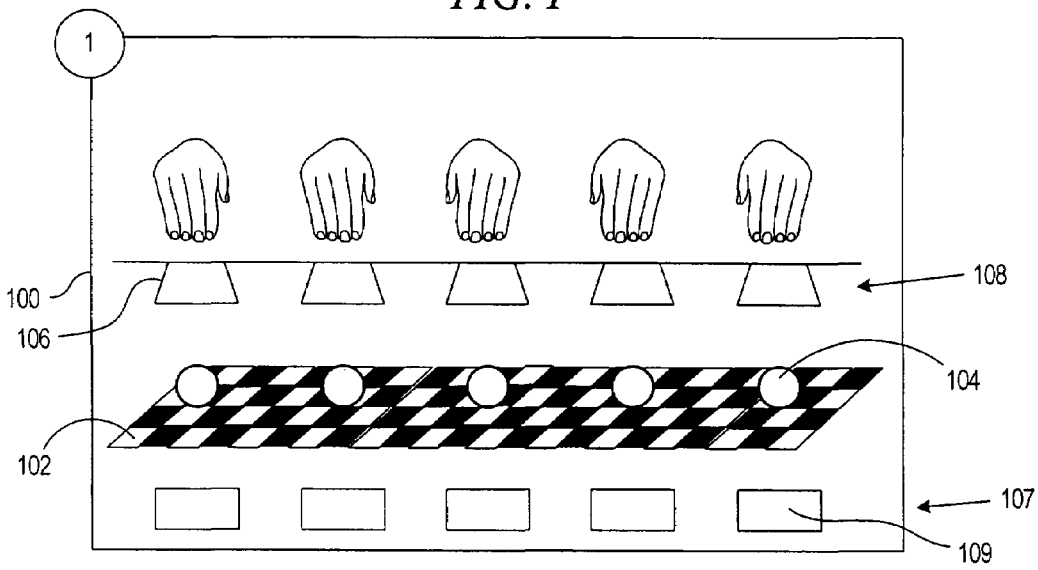
FIG. 1 is an illustration of a shell game activity at an initial phase in accordance with an embodiment of the present invention.

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

In the following description of various exemplary embodiments, reference is made to the accompanying drawings, which form a part hereof, and in which is shown by way of illustration various embodiments in which the invention may be practiced. It is to be understood that other embodiments may be utilized, as structural and operational changes may be made without departing from the scope of the present invention.

Generally, the present invention provides a manner for presenting payouts in gaming activities. The invention may be used in connection with a primary gaming activity and/or in connection with a secondary/bonus activity. A shell game activity of the present invention involves a floor over which a number of cups are positioned. The floor supports a number of award elements. Each award element includes indicia that indicates the relative value of an award associated with the award element. Award elements may also indicate functions, activities, and other information associated with the shell game activity, notwithstanding the colloquial connotation given the term "award." The award elements may be configured as balls, cubes or jewels (e.g., diamonds), for example.

The award elements may be initially covered by respective cups or other obscuring objects. The award elements are presented to the player by moving the cups away from the floor, thereby revealing the award elements. The cups are then moved so as to cover the respective award elements. The cups are moved relative to one another in a motion that mimics traditional shell game cup movements. After repositioning of the cups, the player selects a desired cup. The selected cup is moved away from the associated award element. The player is then awarded the particular award or payout indicated by the award element of the selected cup, noting that the award element may indicate termination of the game without accrual of a payout.

In addition to a basic shell game activity, such as that described immediately above, many variations of the shell game format may be employed. A shell game activity of the present invention may occur in connection with a primary gaming activity or in connection with a secondary or "bonus" activity, as discussed above. A shell game activity of the present invention may be implemented electronically via video presentations, or via a mechanical presentation using physical cups and award elements (e.g., balls). If the shell game activity represents a secondary or bonus game, play of the primary gaming activity may resume upon completion of the shell game activity.

In a particular embodiment, a shell game activity of the present invention is implemented at least in large part mechanistically. According to one approach, the shell game activity is conducted using a false floor mechanism and a user selection interface. The false floor mechanism comprises a false floor structure, a cup or cover manipulation mechanism, and an award element manipulator. These components are controlled in an orchestrated manner to convincingly mimic a human/manual shell game, while ensuring compliance with gaming percentage rules.

Figure 2:
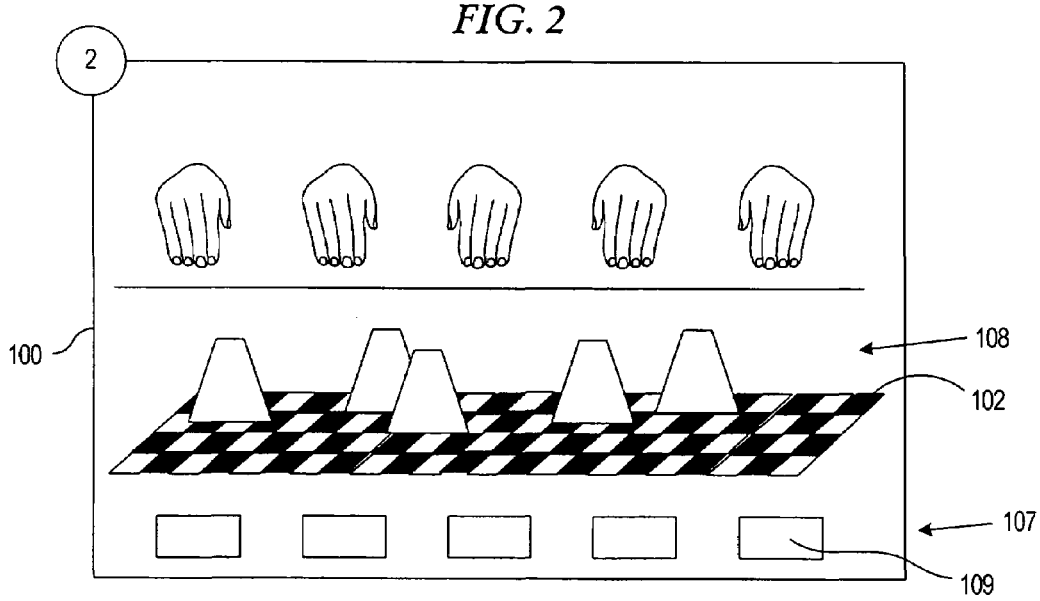
FIG. 2 is an illustration of a shell game activity at an "apparent" shuffling phase in accordance with an embodiment of the present invention.

FIGS. 1-3 are diagrams illustrating one embodiment of a shell game activity in accordance with the present invention. As indicated above, the gaming activity may occur in connection with a primary gaming activity or in connection with secondary or "bonus" activity. The invention may be implemented electronically via video presentations, or via a mechanical presentation using mechanistic components, motors, and controllers.

In accordance with one embodiment of the invention, the gaming activity includes a shell game console 100 that defines the physical structure with which shell game activities of the present invention are conducted. The shell game console 100 may be a standalone structure or may be integral to a larger structure. For example, the shell game console 100 may be integrally coupled to a console structure associated with a primary gaming activity.

The shell game console 100 includes a false floor mechanism, shown to include a false floor structure 102 and a cup manipulation mechanism 108. The false floor structure 102 also includes an award element manipulator 200, best shown in FIGS. 8 and 9. The shell game console 100 further includes a user selection interface 107, which is implemented using selection buttons 109.

FIGS. 1-3 depict different processes in a typical shell game activity. FIG. 1 shows an initial phase of a shell game activity in which the cup manipulation mechanism 108 is in a retracted orientation relative to the false floor structure 102. In this orientation, the award elements 104 are presented to the player. In this embodiment, the award elements 104 are balls ("apparent" balls). In particular, and as best shown in FIGS. 4 and 5, the award elements 104 are configured as three-sided balls, such that each of the three sides of a given ball can include indicia indicative of an award or other symbol. As will be described below, employment of an award element 104 that provides for multiple awards or award levels allows for an increased number of award/award level combinations.

FIG. 2 shows a phase of the shell game activity in which the award elements 104 are subject to "apparent" shuffling by the cup manipulation mechanism 108. In actuality, and as later described, the award elements 104 are retracted from the false floor structure 102 and are replaced by tiles or sections that make the false floor structure 102 appear solid or continuous. As such, actual shuffling of the award elements 104 by the cup manipulation mechanism 108 is fictitious, but gives the appearance that a traditional shell game shuffle process is occurring.

FIG. 3 shows a later phase of the shell game activity in which the player has selected a particular cup 106 via selection buttons 109. In response to actuating a particular selection button 109, the cup manipulation mechanism 108 moves the associated cup 106 away from the false floor structure 102 to reveal the award element 104 under the selected cup 106. The amount of the award is presented on a display 112.

Figure 6:
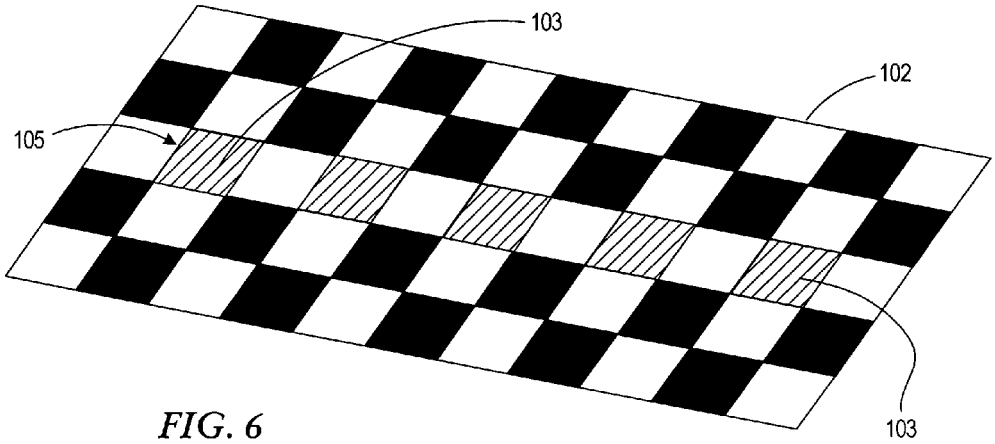
FIGS. 6 and 7 illustrate a false floor structure of a shell game activity in accordance with an embodiment of the present invention.
Figure 7:
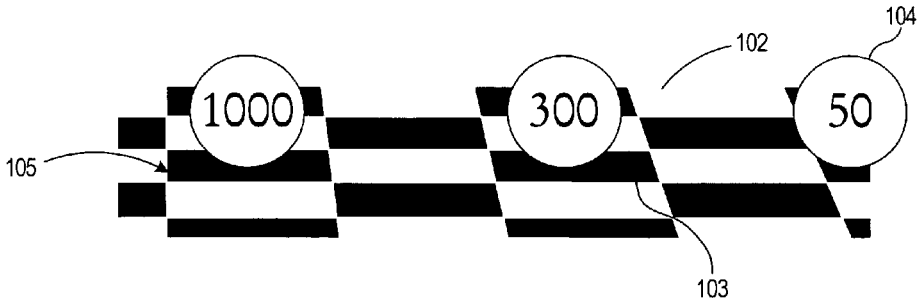

FIGS. 6 and 7 show the false floor structure 102 in greater detail. In this configuration, the false floor structure 102 incorporates a tiled graphic that facilitates presentation of an apparent shell game shuffle operation. As shown, the false floor structure 102 includes a number of configurable sections 105, each of which is associated with an award element 104 (e.g., a ball). More particularly, each of the configurable sections 105 can be configured to selectively provide for presentation of an award element 104 or presentation of a false tile 103. The configurable sections 105 allow for controlled management of the shell game activity in accordance with gaming percentage rules in a manner that is generally unperceivable to the player.

Figure 9:
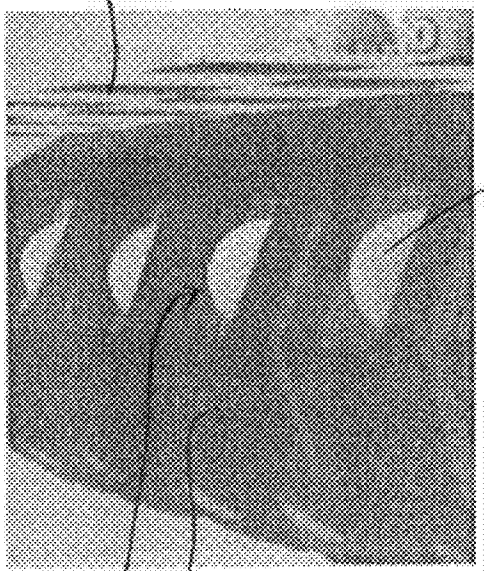
FIGS. 8 and 9 illustrate a false floor mechanism including an award element manipulation mechanism of a shell game activity in accordance with an embodiment of the present invention.
Figure 8:
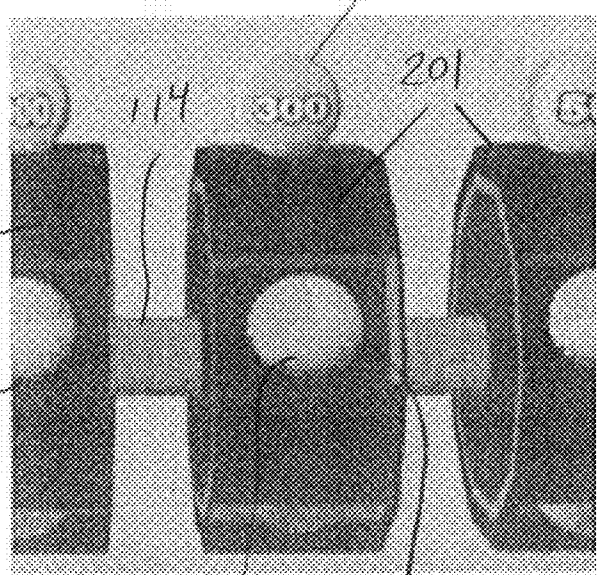

FIGS. 8 and 9 show additional details of the award element manipulator 200. As shown, the award element manipulator 200 includes a number of wheels 201 mounted for controlled rotation about an axle 114. Each wheel 201 is associated with one configurable section 105 of the false floor structure 102 and, therefore, with one of the cups 106 of the cup manipulation mechanism 108. The award element manipulator 200 coordinates selective presentation/retraction of the award elements 104 and false tiles 103 relative to the false floor structure 102.

Each wheel 201 of the award element manipulator 200 includes a number of surfaces or sides that are configured for either award element manipulation or for false tile manipulation. In the particular embodiment shown in FIGS. 8 and 9, each wheel 201 includes a number of flat sections 202 and active sections 204. The flat sections 202 represent surfaces of the wheel 201 that provide for presentation of false tiles 103 of the false floor structure 102. The active sections 204 of the wheel 201 define a recessed portion or well configured to receive an award element 104, such as a ball.

The active sections 204 also incorporate an extension/retraction mechanism that is coupled to an award element 104. Selective actuation of the extension/retraction mechanism facilitates extension and retraction of an award element 104. In use, a particular award element 104 may be controllably extended by the extension/retraction mechanism into a position above the false floor structure 102 at a configurable section 105. A particular award element 104 may also be controllably retracted by the extension/retraction mechanism into a position below the false floor structure 102 at a configurable section 105.

In the retracted orientation, the wheel 201 may be rotated such that a false tile 103 is moved into position within the configurable section 105. The false tile 103 is configured to be planar with respect to the surface of the false floor surface 102 to give the appearance of a continuous surface upon which the shell game activity is conducted.

In the embodiment shown in the Figures, each award element 104 is configured as a three-sided ball. Each side of a given ball includes indicia indicating a payout, such as $50, $300 or $1000, for example. Each wheel 201 of the award element manipulator 200 is configured to include 10 sides or sections, five of which are flat sections 202 that define false tiles 103, and the other five of which are active sections 204 that include the extendable/retractable balls. Each wheel 210 includes five three-sided balls, providing for 15 possible values/symbols. Accordingly, each cup 106 of the cup manipulation mechanism 108 is capable of revealing 15 different values/symbols.

FIGS. 13-16 illustrate features of a shell game activity of the present invention during operation. FIGS. 13-16 provide additional detail of various Figures previously discussed above.

A variety of shell games may be made available for a primary or secondary (e.g., "bonus") gaming activity. For example, the shell game activity may be configured to allow a player to select one of N cups, where N can be 3, 4, or 5, for example. In this configuration, the player is shown a number of balls, each displaying a credit value. Cups are lowered, and the values are subject to "apparent" shuffling according to the present invention. The player is then prompted to choose a cup. The selected cup is lifted and a credit value is revealed.

According to another shell game configuration, a player is shown a number of balls, some displaying a credit value and some displaying a terminate indicator (e.g., a "pooper" as the term is used in the industry). If the terminate indicator is selected, the shell game ends. According to this configuration, cups are lowered, and the values are subject to "apparent" shuffling. The player is then prompted to choose a cup. The player picks cups containing credit values until a terminate indicator is selected. Credits thus accumulate until the "pooper" is picked.

In accordance with a further shell game configuration, the player is shown a number of balls, some displaying a credit value, some displaying an "advance" symbol, and some displaying a terminate indicator. If the advance symbol is selected, the player goes to the next round. According to this configuration, cups are lowered and the values are subject to "apparent" shuffling. The player is then prompted to choose a cup. The player picks cups containing credit values until an advance symbol is selected. Values increase in each successive round. The shell game (e.g., "bonus" round) ends when the last round has been played or when the player selects the terminate indicator.

According to yet another configuration, the player is shown several balls, each displaying a number. Cups are lowered, and the values are subject to "apparent" shuffling according to the present invention. The player is then prompted to choose a cup. The player selects a cup, and a number is revealed. This number becomes the first digit in a five-digit number. The next number selected becomes the second-digit, and so on. The player is awarded the credited value after the fifth pick.

It will be appreciated that other shell game configurations are possible. It will also be appreciated that the shell game activity can be configured to fit a multitude of game themes. For example, by replacing the balls with diamonds as the award elements 104, the game activity can be customizable to fit a gem themed around jewelry. The cups can be replaced with any number of objects, such as barrels or cardboard boxes, for example.

Figure 10:
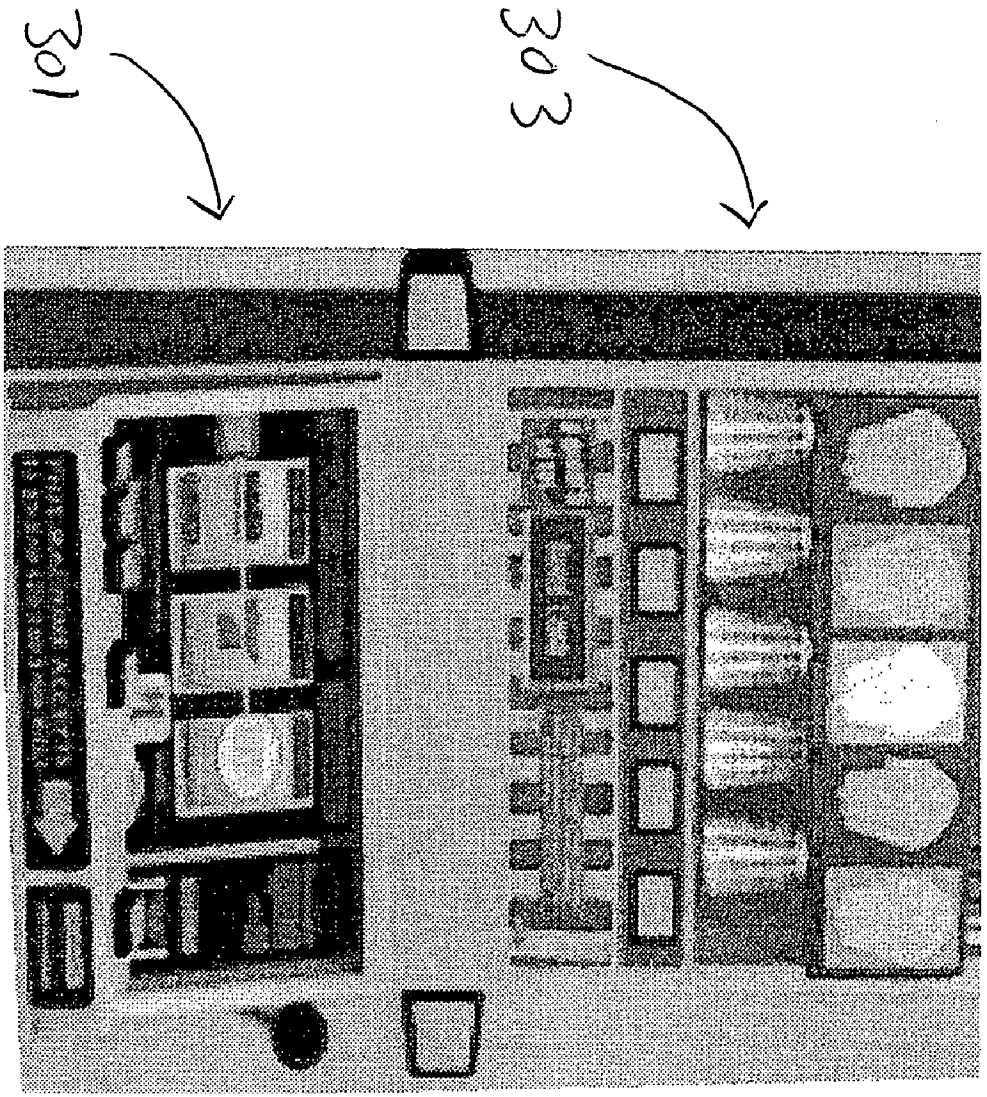
FIG. 10 illustrates a primary gaming activity with an integral secondary shell game activity in accordance with an embodiment of the present invention.

FIG. 10 illustrates one configuration of a primary gaming activity in combination with a shell game activity as described herein. According to this embodiment, the primary gaming activity 301 may be any desired gaming activity, such as a slot machine activity. The shell game activity 303 is configured to be a secondary or bonus game. The shell game activity 303 is selectively enabled and disabled for play based on pre-established conditions dictated by the primary gaming activity.

Figure 11:
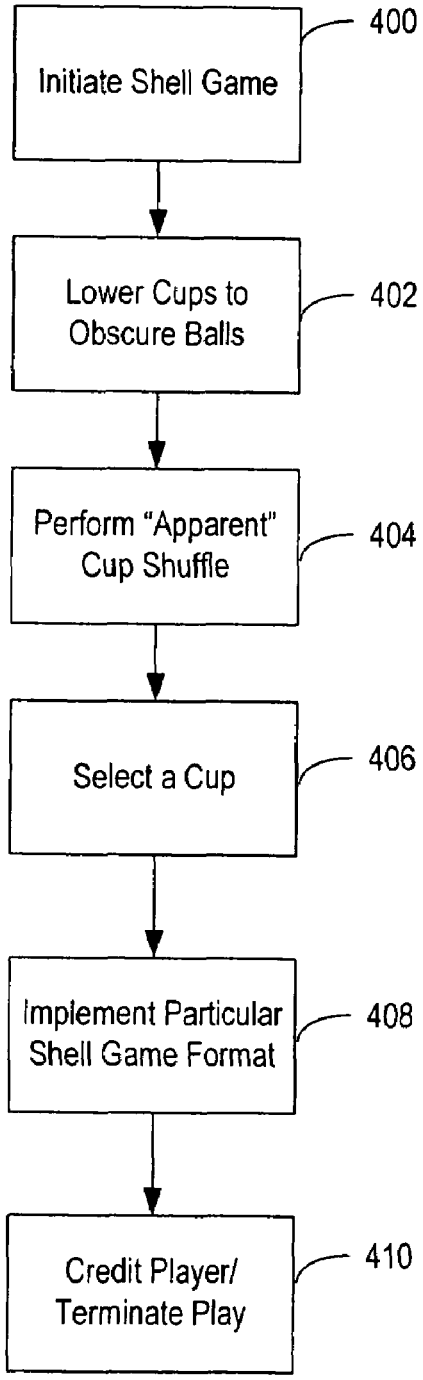
FIG. 11 is a flow diagram of various processes associated with a shell game activity in accordance with an embodiment of the present invention.

FIG. 11 is a flow diagram illustrating various processes for performing a shell game activity in accordance with an embodiment of the present invention. The shell game is initiated 400, and the cups are lowered 402 to cover the balls. The balls are subject to "apparent" shuffling 404 in a manner previously described. The player then selects 406 a cup or cups in accordance with a particular shell game format. The player continues to play 408 the shell game activity in accordance with the operative shell game format. At the conclusion of the shell game activity, the player is credited (if payout is due) and play is terminated 410.

Figure 12:
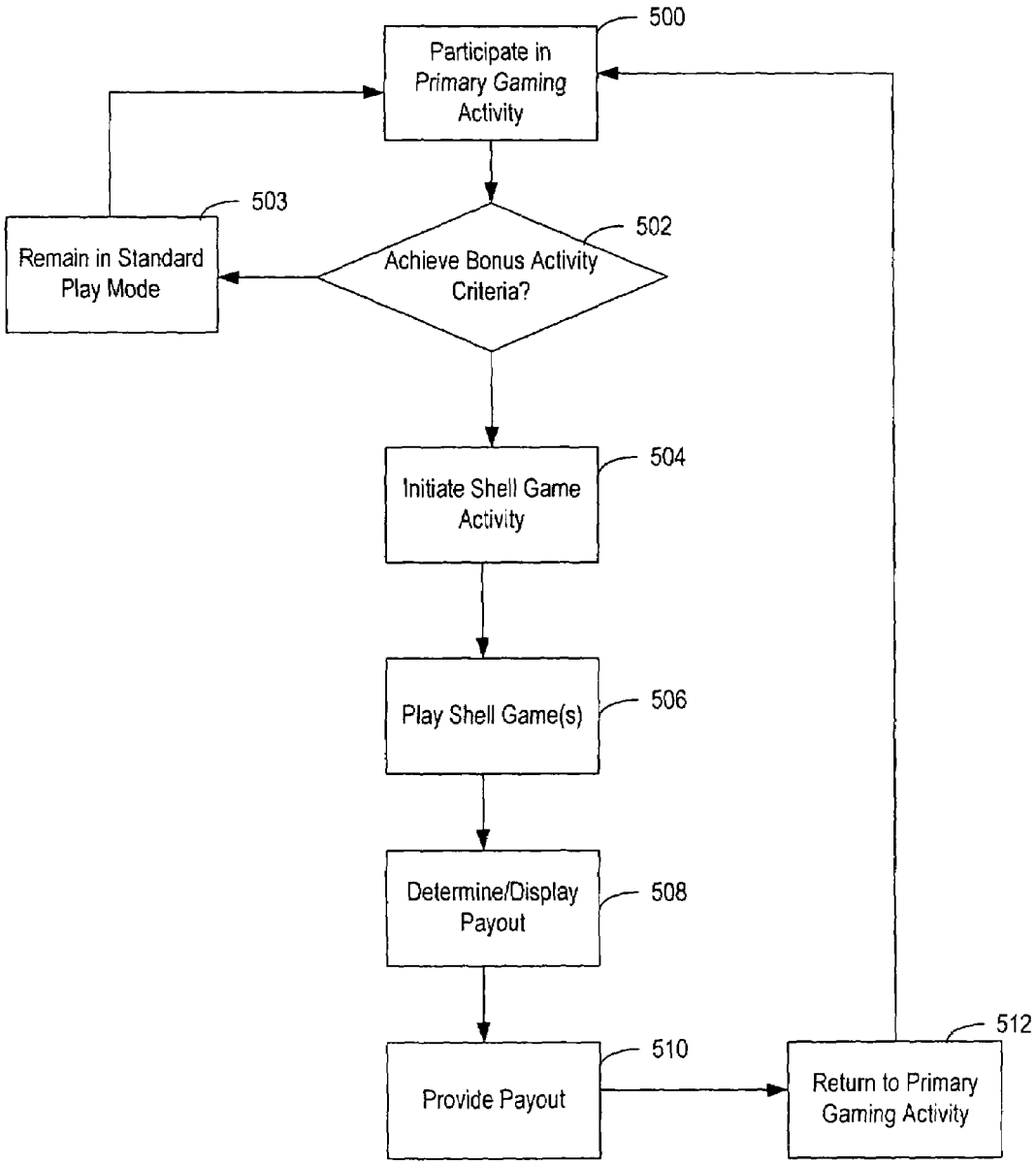
FIG. 12 is a flow diagram of various processes associated with a primary gaming activity and a secondary shell game activity in accordance with an embodiment of the present invention.
Figure 13:
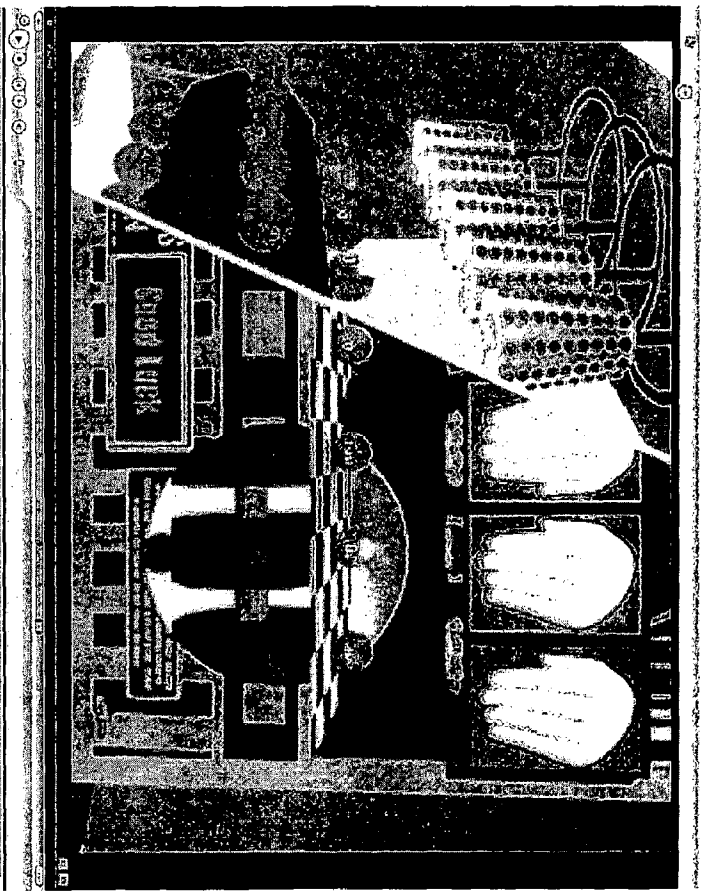
FIGS. 13-16 illustrate additional features of a shell game activity of the present invention during operation.
Figure 14:
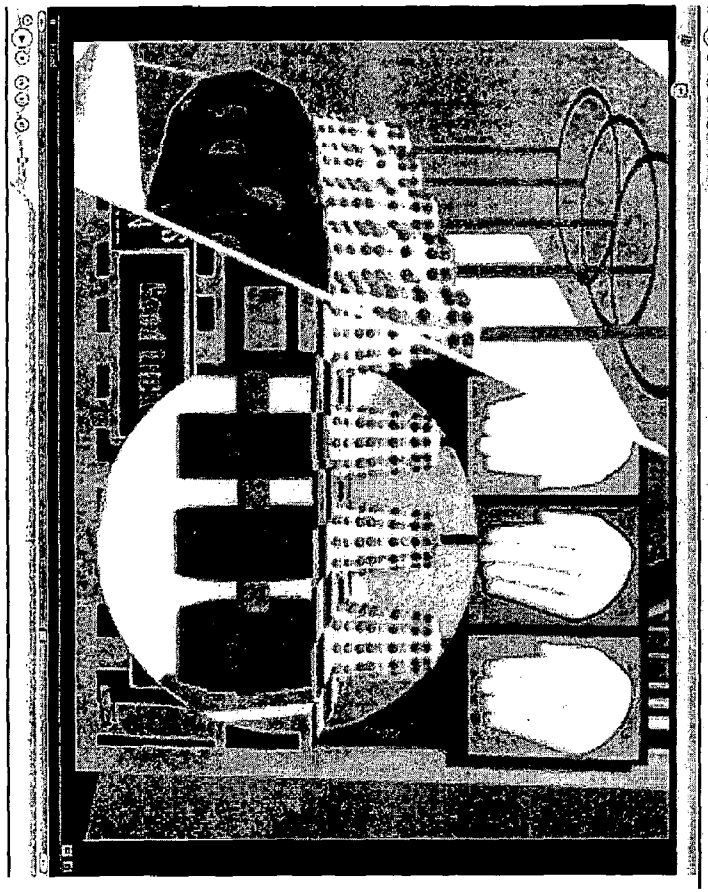
Figure 15:
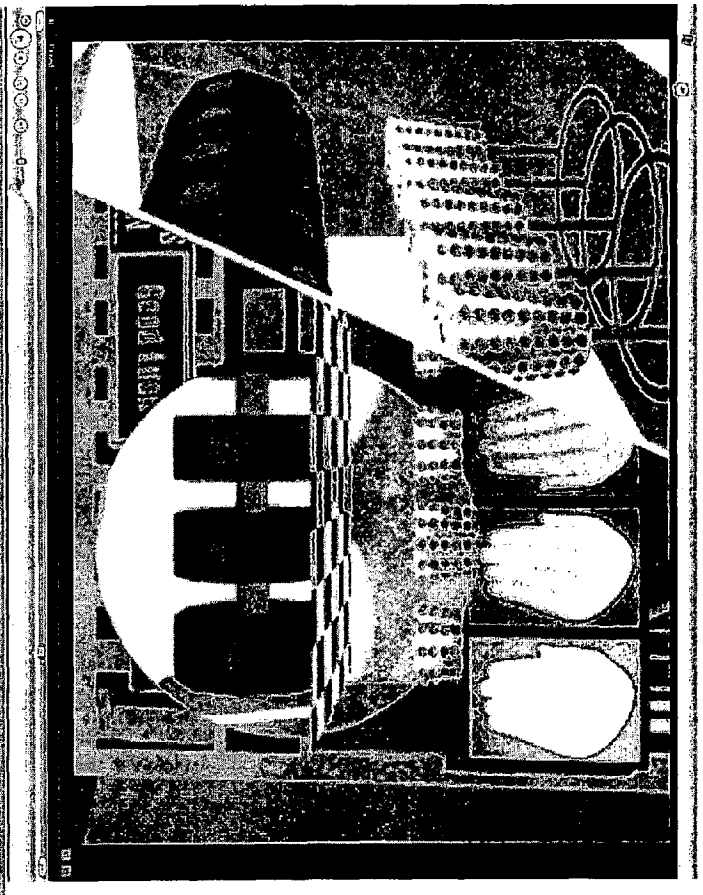
Figure 16:
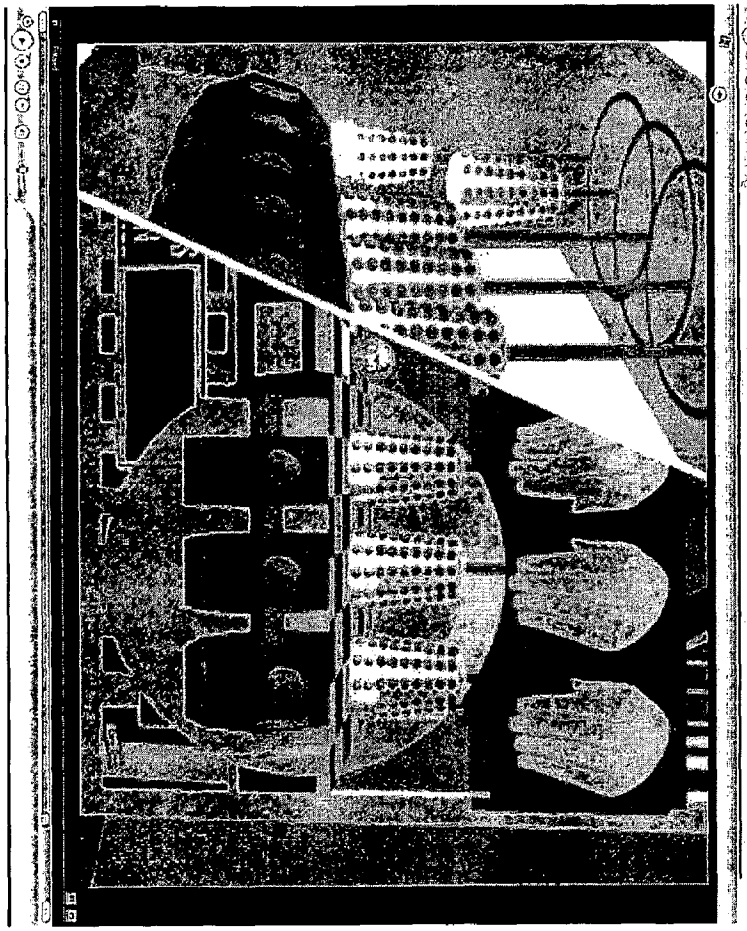

FIG. 12 is a flow diagram illustrating an embodiment of a method for presenting payouts in connection with a bonus activity according to the present invention. The system allows a player to participate 500 in a primary gaming activity, which may include any desired gaming activity such as slot games, poker games, or other conventional games played on slot machine-style games. For example, the system may be a mechanical or video slot machine having a plurality of reels, and having one or more paylines. When any of one or more predetermined symbol combinations occurs via the primary gaming activity, the player will be allowed to enter a secondary or "bonus" activity.

In the illustrated embodiment, if the player does not achieve the bonus activity criteria, as determined at decision block 502, the player remains 503 in the standard play mode. Otherwise, the player enters the bonus round, where the shell game activity is initiated 504. The player plays 506 the shell game activity in accordance with the format of the operative shell game configuration. A bonus payout is determined 508 based on the credits accumulated during shell game play (if any). The accumulated credits enables a payout to be determined and provided 510 to the player. At the conclusion of the shell game activity, the primary gaming activity is resumed 512.

Figure 17:
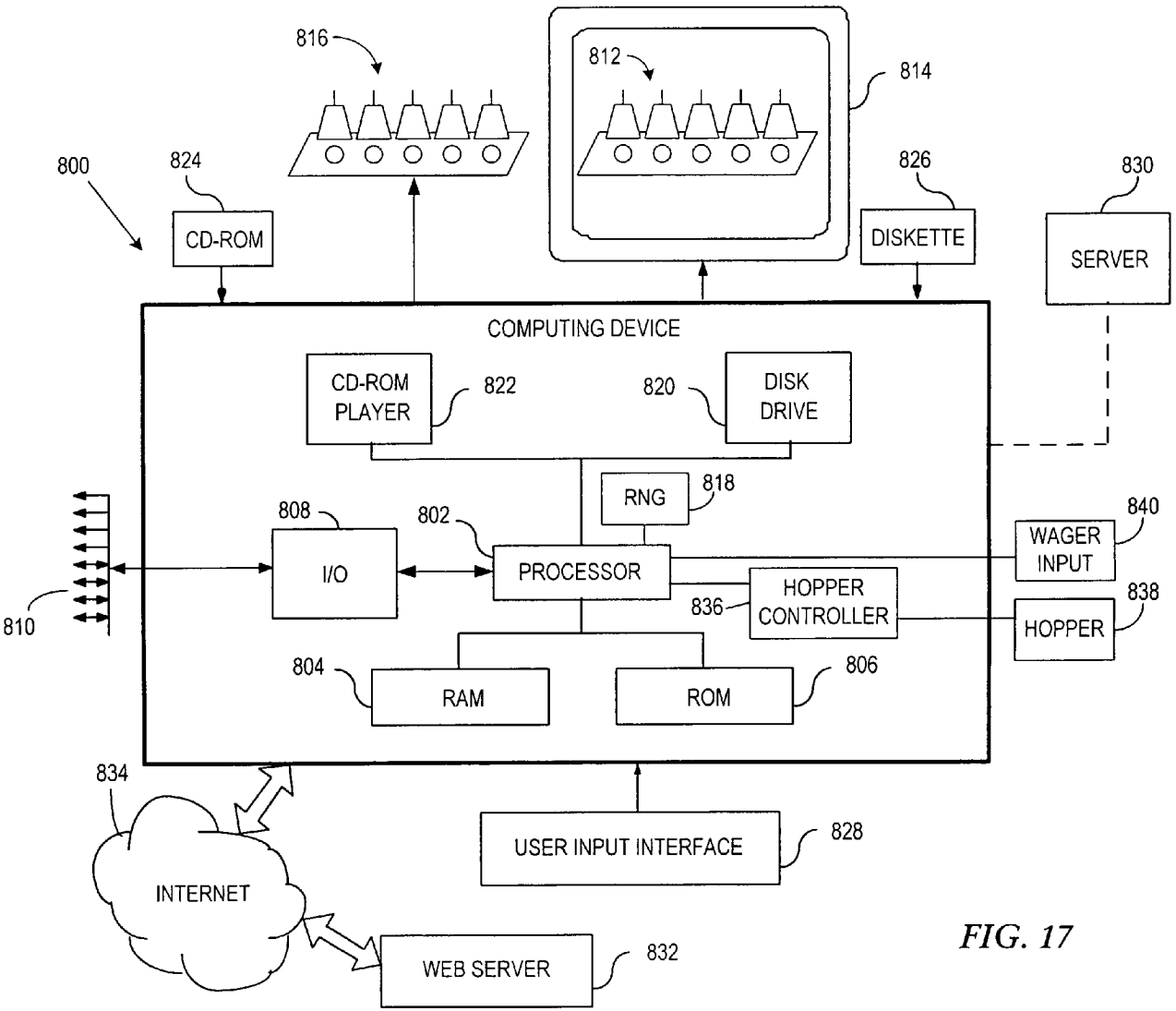
FIG. 17 is a block diagram of electronics for controlling a shell game activity and optionally a primary gaming activity in accordance with an embodiment of the present invention.

The gaming machines described in connection with the present invention may be independent casino gaming machines, such as slot machines or other special purpose gaming kiosks, video games, or may be computing systems operating under the direction of local gaming software and/or remotely-provided software such as provided by an application service provider (ASP). The casino gaming machines utilize computing systems to control and manage the gaming activity. An example of a representative computing system capable of carrying out operations in accordance with the invention is illustrated in FIG. 17.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 800 of FIG. 17 is an example computing structure that can be used in connection with the primary gaming activity and/or bonus gaming activity for such electronic gaming machines.

An illustrative computing arrangement 800 suitable for performing the shell game primary and/or bonus activity in accordance with the present invention typically includes a central processor (CPU) 802 coupled to random access memory (RAM) 804 and some variation of read-only memory (ROM) 806. The ROM 806 may also be other types of storage media to store programs, such as programmable ROM (PROM), erasable PROM (EPROM), etc. The processor 802 may communicate with other internal and external components through input/output (I/O) circuitry 808 and bussing 810, to provide control signals, communication signals, and the like.

Chance-based gaming systems such as slot machines, in which the present invention is applicable, are governed by random numbers and processors. Control of an electronic shell game 812 on a display 814, and/or control of mechanical components of the mechanistic shell game activity 816 in accordance with the invention are provided in part by a random number generator (RNG). RNGs are well known in the art, and may be implemented using hardware, software operable in connection with the processor 802, or some combination of hardware and software. In accordance with generally known technology in the field of slot machines, the processor 802 associated with the slot machine, under appropriate program instruction, can simulate actuation of the shell game, including rotation of the wheels and balls of the award element manipulator shown in the Figures. The present invention is operable using any known RNG, and may be integrally programmed as part of the processor 802 operation, or alternatively may be a separate RNG controller 818. RNGs are well known in the art, and any type of RNG may be implemented for the standard mode of play and/or the bonus mode of play in accordance with the invention.

The computing arrangement 800 may also include one or more data storage devices, including hard and floppy disk drives 820, CD-ROM drives 822, and other hardware capable of reading and/or storing information such as DVD, etc. In one embodiment, software for carrying out the standard and/or bonus gaming operations in accordance with the present invention may be stored and distributed on a CD-ROM 824, diskette 826 or other form of media capable of portably storing information. These storage media may be inserted into, and read by, devices such as the CD-ROM drive 822, the disk drive 820, etc. The software may also be transmitted to the computing arrangement 800 via data signals, such as being downloaded electronically via a network, such as the Internet.

Further, as previously described, the software for carrying out the functions associated with the present invention may alternatively be stored in internal memory/storage of the computing device 800, such as in the ROM 806. The computing arrangement 800 may be coupled to a display 814, which represents a display on which the gaming activities in accordance with the invention may be presented. The display 814 may represent the "presentation" of the video information in accordance with the invention, and may be any type of known display or presentation screen, such as LCD displays, plasma display, cathode ray tubes (CRT), etc. Where the computing device 800 represents a stand-alone or networked computer, the display 814 may represent a standard computer terminal or display capable of displaying multiple windows, frames, etc. A user input interface 828 such as a mouse or keyboard may be provided where the computing device 800 is associated with a standard computer. User input interface devices may include buttons, joysticks, keyboard, mouse, microphone, touch pad, touch screen, voice-recognition system, etc.

The computing arrangement 800 may be connected to other computing devices or gaming machines, such as via a network. The computing arrangement 800 may be connected to a network server 830 in an intranet or local network configuration. The computer may further be part of a larger network configuration as in a global area network (GAN) such as the Internet. In such a case, the computer accesses one or more web servers 832 via the Internet 834.

Other components directed to slot machine implementations include manners of gaming participant payment, and gaming machine payout. For example, a slot machine including the computing arrangement 800 may also include a hopper controller 836 to determine the amount of payout to be provided to the participant. The hopper controller may be integrally implemented with the processor 802, or alternatively as a separate hopper controller 836. A hopper 838 may also be provided in slot machine embodiments, where the hopper serves as the mechanism holding the coins/tokens of the machine. The wager input module 840 represents any mechanism for accepting coins, tokens, coupons, bills, credit cards, smart cards, membership cards, etc. for which a participant inputs a wager amount.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather determined by the claims appended hereto.

What is claimed is:

1. An apparatus for presenting gaming payouts, comprising:

a floor structure comprising a plurality of false floor elements;

a plurality of physical award elements configured to physically couple to the plurality of false floor elements;

a plurality of physical obscuring elements controllable to selectively obscure the plurality of physical award elements;

an extension/retraction mechanism coupled to the plurality of physical award elements configured to temporarily retract the plurality of physical award elements to an opposite side of the floor structure;

an obscuring element manipulator controllable to manipulate the plurality of physical obscuring elements, thereby performing an apparent shuffling of the plurality of physical award elements; and a user selection interface to facilitate user selection of one or more of the physical obscuring elements, wherein the extension/retraction mechanism is further configured to extend at least the physical award elements associated with the selected one or more selected physical obscuring elements through the floor structure upon user selection of the one or more of the physical obscuring elements.

2. The apparatus as in claim 1, wherein the user selection interface is coupled to the obscuring element manipulator, such that the obscuring element manipulator reveals the one or more of the plurality of award elements in response to a user selection.

3. The apparatus as in claim 1, wherein the plurality of award elements comprise balls, each ball segmented into a plurality of segments, each segment having a symbol presented on the segment.

4. The apparatus as in claim 1, wherein the plurality of award elements comprise balls, each ball having a symbol presented on the ball.

5. The apparatus as in claim 4, wherein at least one ball comprises a stop symbol.

6. The apparatus as in claim 4, wherein at least one ball comprises a re-spin symbol.

7. The apparatus as in claim 1, wherein the apparatus for presenting gaming payouts is provided as a bonus feature of a gaming system.

8. The apparatus as in claim 7, wherein the gaming system comprises a slot machine.

9. The apparatus as in claim 7, wherein the gaming system comprises a video poker machine.

10. The apparatus as in claim 7, wherein the gaming system comprises a video bingo machine.

11. The apparatus as in claim 7, wherein the gaming system comprises a video keno machine.

* * * * *